US007757885B2

(12) United States Patent
Goeking et al.

(10) Patent No.: US 7,757,885 B2
(45) **Date of Patent: *Jul. 20, 2010**

(54) DISPOSABLE CONTAINER WITH DEFORMABLE BRIM

(75) Inventors: Harold J. Goeking, Oshkosh, WI (US); Rebecca E. Whitmore, Chilton, WI (US); William Schultz, Atlanta, GA (US); Janica S. Behnke, Appleton, WI (US)

(73) Assignee: Dixie Consumer Products LLC, Atlanta, GA (US)

( * ) Notice: Subject to any disclaimer, the term of this patent is extended or adjusted under 35 U.S.C. 154(b) by 692 days.

This patent is subject to a terminal disclaimer.

(21) Appl. No.: 11/081,392

(22) Filed: Mar. 15, 2005

(65) Prior Publication Data

US 2005/0211713 A1 Sep. 29, 2005

Related U.S. Application Data

(63) Continuation-in-part of application No. 10/402,718, filed on Mar. 28, 2003, now Pat. No. 6,883,677.

(51) Int. Cl.
*A47G 19/22* (2006.01)

(52) U.S. Cl. ..... 220/713; 220/711; 220/229; 229/404; 229/400

(58) Field of Classification Search ..... 220/711, 220/713, 309.1, 309.2, 780, 781, 784, 229; 229/400, 404, 906
See application file for complete search history.

(56) References Cited

U.S. PATENT DOCUMENTS 1,514,930 A * 11/1924 Reynolds ..... 220/309.2
2,816,548 A 12/1957 Tupper et al. ..... 215/11.1
3,139,064 A 6/1964 Harle
3,883,036 A * 5/1975 Mahaffy et al. ..... 220/781
4,333,584 A * 6/1982 Gall ..... 220/309.1
4,421,244 A 12/1983 Van Melle ..... 220/781
4,756,440 A 7/1988 Gartner ..... 220/711
4,795,052 A 1/1989 Hayes, Jr. ..... 220/90.4
4,915,250 A 4/1990 Hayes, Jr. ..... 220/90.4
5,117,994 A 6/1992 Leblanc et al.
5,186,347 A 2/1993 Freeman et al. ..... 220/254.1
5,213,236 A 5/1993 Brown et al. ..... 222/185
5,253,781 A 10/1993 Van Melle et al. ..... 220/713
5,273,172 A 12/1993 Rossbach et al. ..... 215/229
5,339,995 A 8/1994 Brown et al. ..... 222/185
5,363,983 A 11/1994 Proshan ..... 220/717
5,377,877 A 1/1995 Brown et al. ..... 222/105

(Continued)

OTHER PUBLICATIONS

Advertisement "The First Years Take & Toss Spill-Proof 10 oz. Cups, from 9 Months", http://www.drugstore.com (Date unknown).

(Continued)

*Primary Examiner*—Anthony Stashick
*Assistant Examiner*—Christopher B McKinley

(57) ABSTRACT

A container comprising at least one receptacle wall defining an opening. A brim is formed about the opening. The brim includes a brim curl in a first configuration. The brim curl is adapted to deform into a second configuration. The container may further comprise a lid removably and sealingly engaged to the receptacle. The lid is adapted to deform the brim curl upon removal of the lid from the receptacle. The lid cannot sealingly engage the deformed brim curl.

13 Claims, 11 Drawing Sheets

U.S. PATENT DOCUMENTS

| | | | | |
|---|---|---|---|---|
| 5,392,968 | A | 2/1995 | Dark | 222/529 |
| 5,409,144 | A | 4/1995 | Brown | 222/185 |
| 5,439,143 | A | 8/1995 | Brown et al. | 222/185 |
| 5,538,157 | A | 7/1996 | Proshan | 220/717 |
| 5,542,670 | A | 8/1996 | Morano | 220/714 |
| 5,645,191 | A | 7/1997 | Neville | 220/717 |
| D385,748 | S | 11/1997 | Iodice et al. | D7/510 |
| D397,906 | S | 9/1998 | Briggs et al. | D7/392.1 |
| 6,047,851 | A * | 4/2000 | Freek et al. | 220/780 |
| 6,102,245 | A | 8/2000 | Haberman | 220/714 |
| 6,112,926 | A | 9/2000 | Fishman | 215/389 |
| 6,118,457 | A | 9/2000 | Haberman | |
| 6,142,331 | A * | 11/2000 | Breining et al. | 220/62.12 |
| 6,571,981 | B2 | 6/2003 | Rohlfs | 220/713 |
| 6,612,456 | B1 | 9/2003 | Hundley et al. | 220/254.3 |
| 2002/0158075 | A1 | 10/2002 | Caldicott et al. | |
| 2003/0066839 | A1 | 4/2003 | Connors, Jr. et al. | |
| 2003/0085232 | A1 | 5/2003 | Leinenweber | |
| 2004/0031714 | A1 | 2/2004 | Hanson | |

OTHER PUBLICATIONS

U.S. Appl. No. 11/114,909, filed Apr. 25, 2005, Goeking, et al.
U.S. Appl. No. 11/081,481, filed Mar. 15, 2005, Goeking, et al.

* cited by examiner

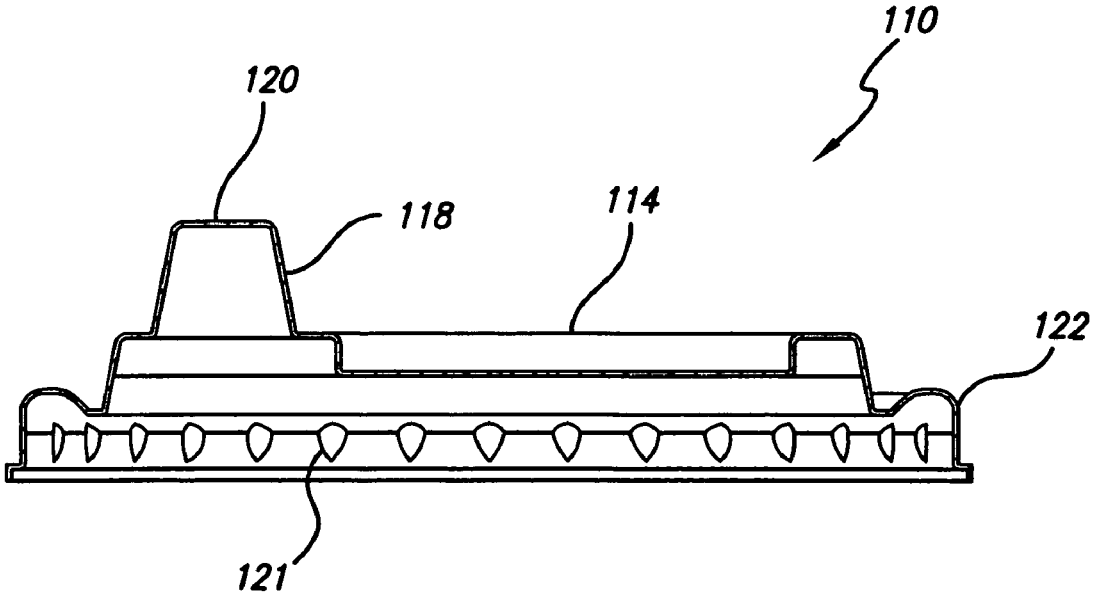
FIG. 3
FIG. 4
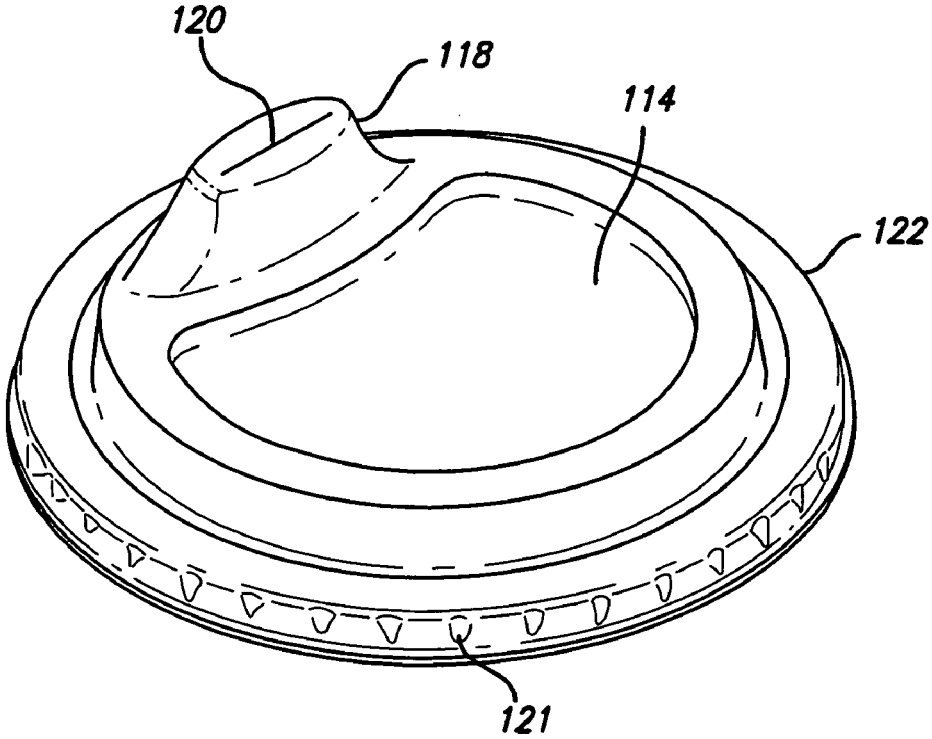

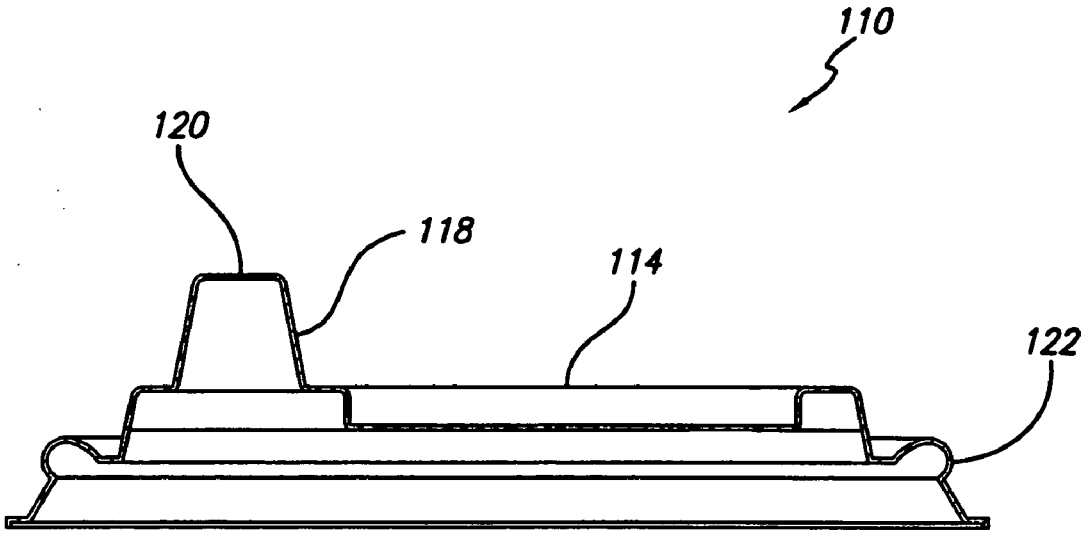
FIG. 5
FIG. 6
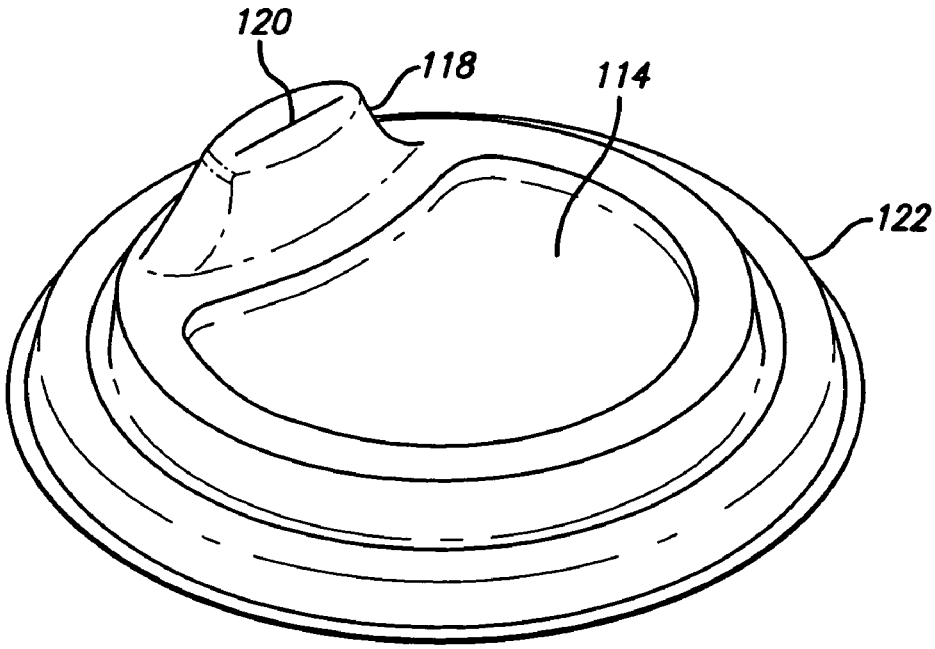

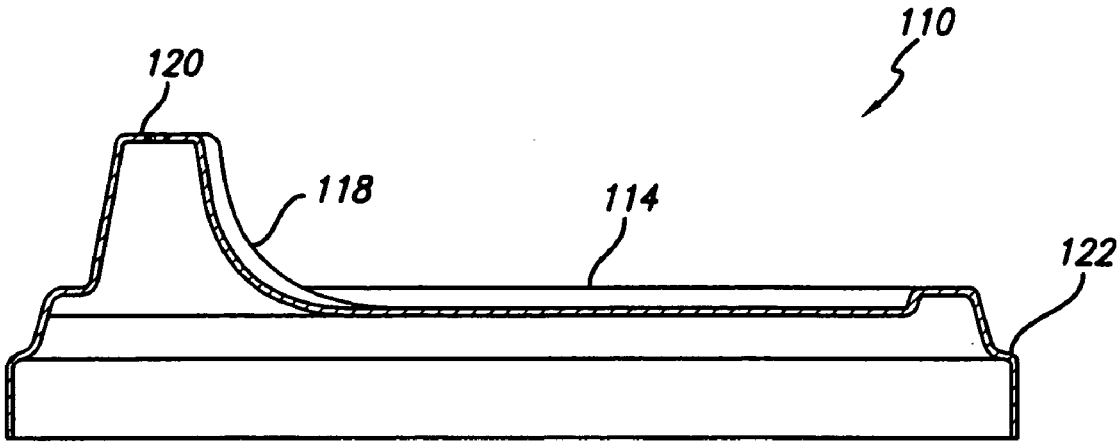
FIG. 9
FIG. 10
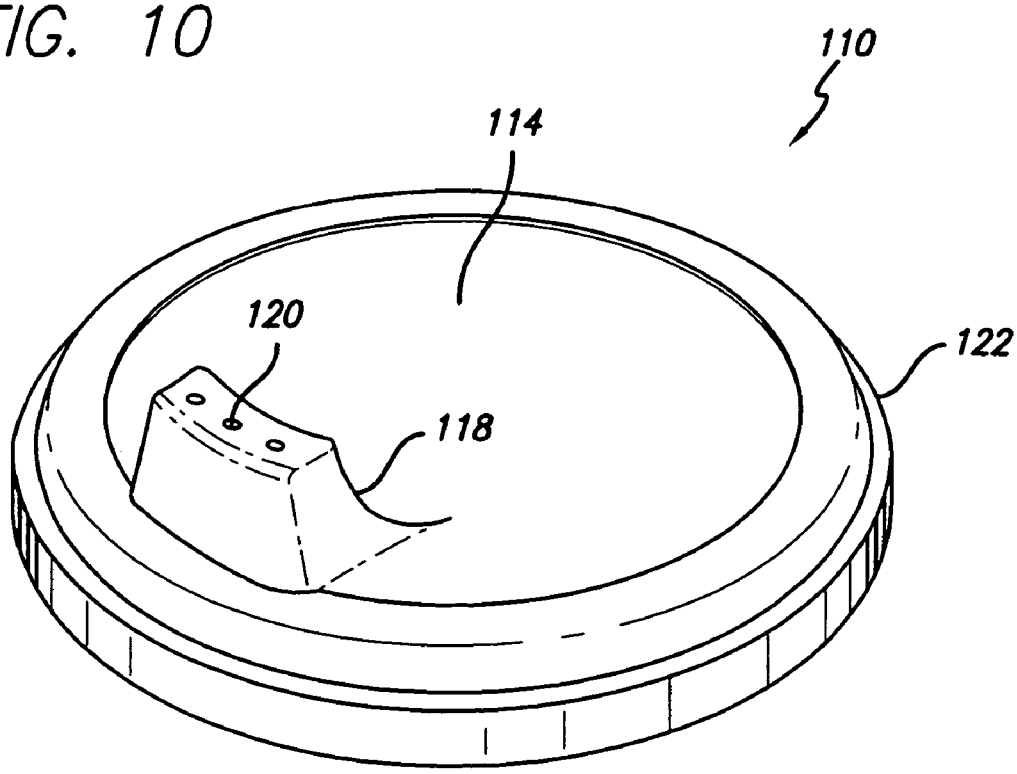

DISPOSABLE CONTAINER WITH DEFORMABLE BRIM

PRIORITY

Priority is claimed as a continuation-in-part to U.S. patent application having Ser. No. 10/402,718, filed on Mar. 28, 2003, now U.S. Pat. No. 6,883,677, the disclosure of which is incorporated herein by reference.

BACKGROUND OF THE INVENTION

1. Field of the Invention

The field of the present invention is disposable containers, such as cups, bowls, plates, and the like, for serving and storing consumable goods, particularly perishable goods.

2. Background

Sippy cups, or drinking devices suitable for use by young children, exemplify some of the shortcomings that exist in the prior art relating to disposable containers. At present, a variety of non-disposable sippy cup designs are available, with many having the strength and durability that is desired by consumers, enhanced leak resistance through a sealable and removable lid, suitable insulation for hot beverages, and an exterior that is "soft" to the touch. The removable lid enables the consumer to repeatedly refill the cup with any desired beverage. When such cups are repeatedly refilled with liquids that have a high sugar content, such as juice or milk, and are often not refrigerated, the cup becomes an excellent environment for bacterial colonization and propagation. Children using such cups are therefore at greater risk of exposure to unhealthy and potentially deadly amounts of bacteria. Cups which do not enable this potentially harmful practice of repeatedly refilling cups and creating a bacterial breeding ground are therefore desirable.

One potential method of reducing or eliminating this practice is to make cups disposable. However, many consumers frequently reuse even "disposable" cups. Many such cups are manufactured by an injection molding process in order to acquire sufficient strength and durability. These cups often include relatively thick walls and are of a fairly heavy construction. As such, even though a cup is manufactured to be disposed of after a single use, a consumer may not view the cup as being disposable.

SUMMARY OF THE INVENTION

The present invention is directed toward a disposable container. The container comprises at least one receptacle wall defining an opening. A brim is formed about the opening and includes a brim curl in a first configuration. The brim curl is deformable from the first configuration into a second configuration. The container may also include a lid which is removably and sealingly engaged to the brim. When the lid is disengaged from the brim, the brim is deformed. In deforming the brim, the lid causes the brim curl to deform from the first configuration into the second configuration. The lid and the brim curl are designed and configured so that the lid cannot sealingly engage the deformed brim.

Accordingly, the present invention provides an improved disposable container. Other objects and advantages will appear hereinafter.

BRIEF DESCRIPTION OF THE DRAWINGS

In the drawings, wherein like reference numerals refer to similar components:

FIG. 3 is a side sectional view of another embodiment of a lid;

FIG. 4 is a perspective view of the lid of FIG. 3;

FIG. 5 is a side sectional view of yet another embodiment of a lid;

FIG. 6 is a perspective view of the lid of FIG. 5;

FIG. 9 is a side sectional view of yet another embodiment of a lid;

FIG. 10 is a perspective view of the lid of FIG. 9;

DETAILED DESCRIPTION OF THE PREFERRED EMBODIMENTS

Figure 1:
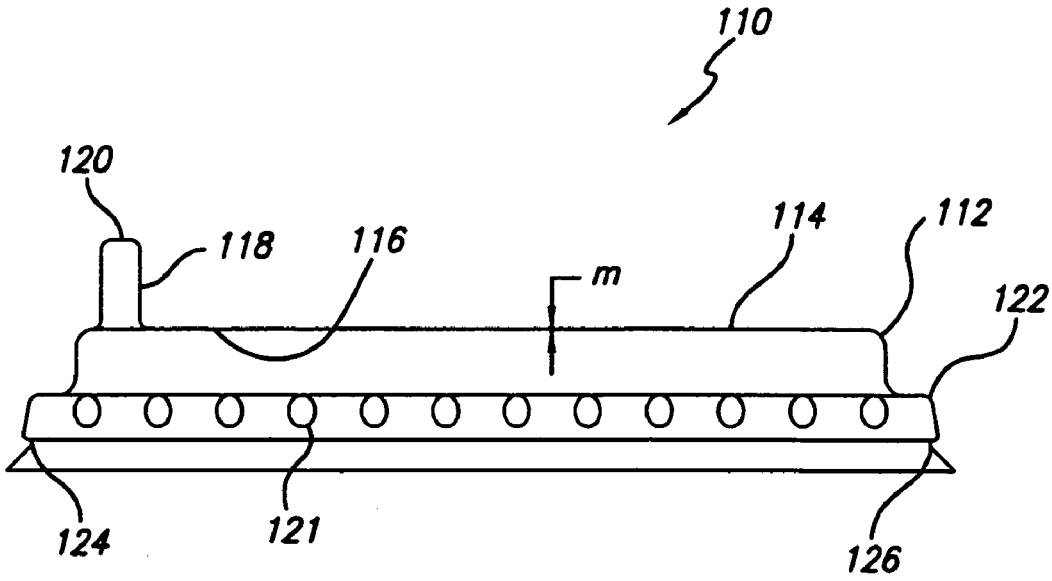
FIG. 1 is a side plan view of a first embodiment of a lid.
Figure 16:
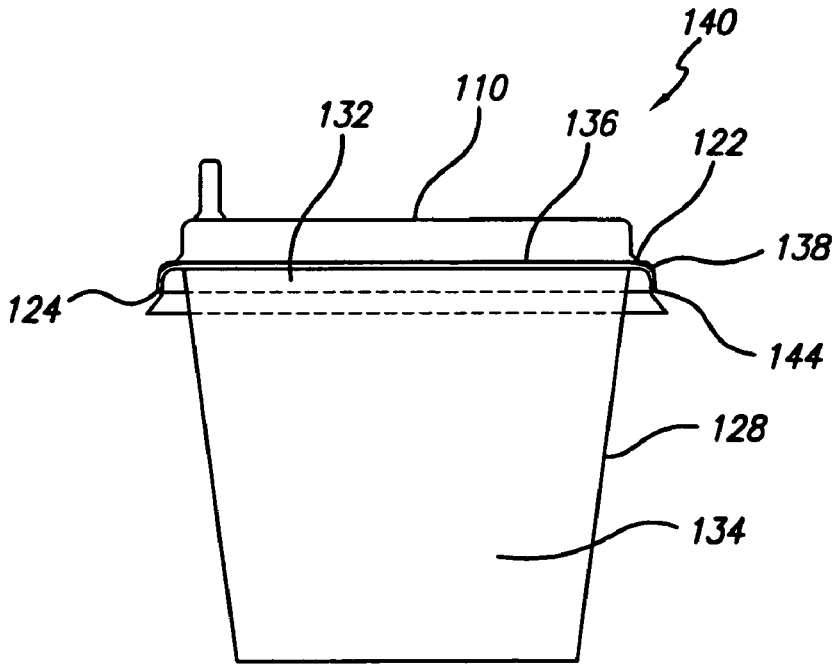
FIG. 16 is a side sectional view of a cup sealingly engaged to a lid.

Turning in detail to the drawings, FIG. 1 shows a lid 110. The lid 110 includes a crown 112, a spout 118, and a skirt 122. The spout 118 extends outward from the crown top 114 and includes at least one opening 120 which provides a passage from the crown top 114 through to the crown bottom 116. The spout 118 and associated opening 120 facilitate 'sipping' by the user. Liquid may pass through the opening 120 when the lid 110 is sealingly seated on the brim of a cup (as shown in FIG. 16). The skirt 122 includes inwardly protruding ribs 121 and an angular rim 124. The lid skirt 122 is generally defined by a skirt diameter, a, which is approximately the same diameter as the brim of the cup to which the lid is to be attached. The angular rim 124 includes an internal rim surface and is generally defined by the rim diameter, b, which is smaller than the skirt diameter, a. The ribs 121 and the angular rim 124, in combination, are configured to securely associate the lid 110 with the brim of a cup.

The lid 110 has a thickness, m, of approximately $^{10}/_{1000}$ in., which advantageously allows the lid 110 to be relatively strong, durable, and truly disposable. Alternatively, the lid may have a thickness, m, of between $^{9}/_{1000}$ in. to $^{25}/_{1000}$ in. or greater. The lid 110 is preferably constructed using a thermoform process with a translucent plastic and/or composite material. However, the lid 110 may be constructed of any material and/or combination of materials suitable to the desired end purpose, such polyester (APET), polypropylene or polyethylene—alone or as a coating on a paperboard substrate, which might be much more suitable from a child safety standpoint.

Figure 2:
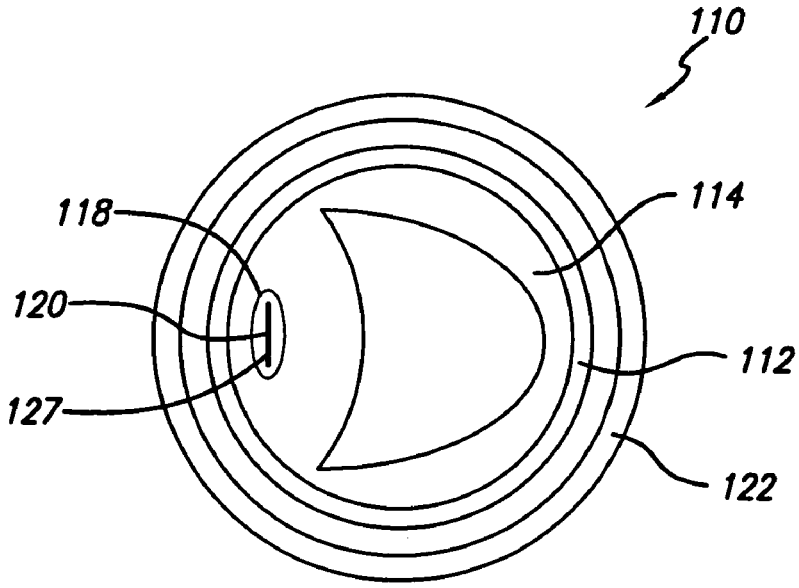
FIG. 2 is a top plan view of the lid of FIG. 1.

FIG. 2 illustrates the opening 120 in the spout 118, which generally allows liquid to be sucked out of an attached cup while providing at least some spill/leak resistance. The opening 120 shown in FIG. 2 is a self healing slit (which is exaggerated for purposes of illustration). The self healing slit flexibly, deformably, and resiliently increases in size to dispense liquid when suction, i.e. pressure that is less than ambient air pressure, is applied to the spout 118. Upon termination of suction, the self healing slit returns to its original size and shape to prevent liquid from escaping from the attached cup. Such a self healing slit may be formed by making a single slit in the spout 118 of a thermoformed lid 110 using a narrow blade without removing material from the spout 118. A tool and die arrangement (not shown) for making the slit in the spout may be used. The die is placed on an opposite side of the spout from a blade and includes a slot for receiving the blade. The die provides opposite side support for the spout as the blade pierces and cuts the spout to create the slit. This arrangement helps minimize deformation of the plastic during the slit-cutting, process, which is an important factor in creating the self-healing slit.

Self healing slits are not present in injection molded lids because injection molded lids are thicker and less resilient than thermoformed lids. A self healing slit advantageously provides for greater leak resistance capability than is possible with injection molded lids that do not have insert molded or assembled elastomeric valves.

FIG. 3 illustrates a lid 110*a* having a skirt 122*a* which does not include an angular rim. The ribs 121*a* and the top portion 123*a* of the skirt 122*a*, in combination, are configured to securely associate the lid 110*a* with the brim of a cup. FIG. 4 illustrates this alternative lid 110*a* in perspective.

FIG. 5 illustrates a lid 110*b* having a skirt 122*b* which includes an angular rim 124*b*, but does not include ribs. The angular rim 124*b* and the top portion 123*b* of the skirt 122*b*, in combination, are configured to securely associate the lid 110*b* with the brim of a cup. FIG. 6 illustrates this alternative lid 110*b* in perspective.

Figure 7:
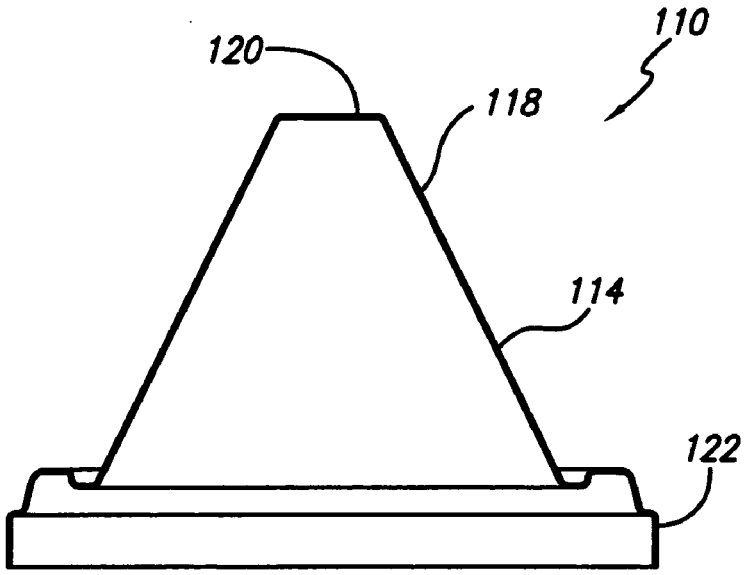
FIG. 7 is a side sectional view of yet another embodiment of a lid.
Figure 8:
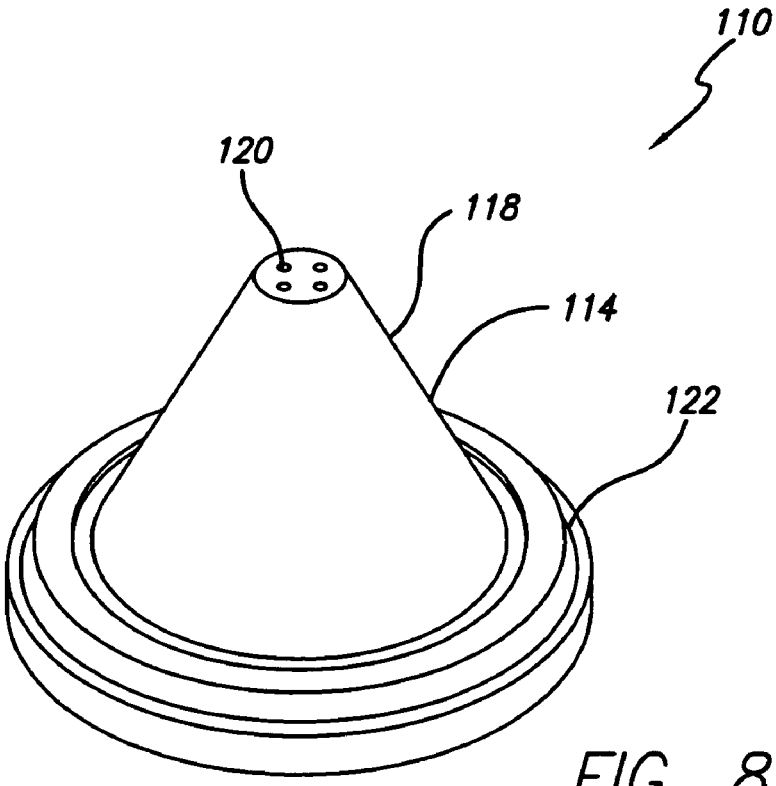
FIG. 8 is a perspective view of the lid of FIG. 7.

FIG. 7 illustrates a lid 110*c* having a conical spout 118*c* as compared to the previously described lids. As shown in FIG. 8, a plurality of holes 120*c* serve as the opening of the spout 118*c* through which liquid contained in an attached cup may be dispensed.

FIGS. 9 & 10 illustrate a lid 110*d* similar to the one depicted in FIG. 3. The spout 118*d* of this lid 110*d* includes a plurality of holes 120*d* through which liquid contained in an attached cup may be dispensed.

Figure 11:
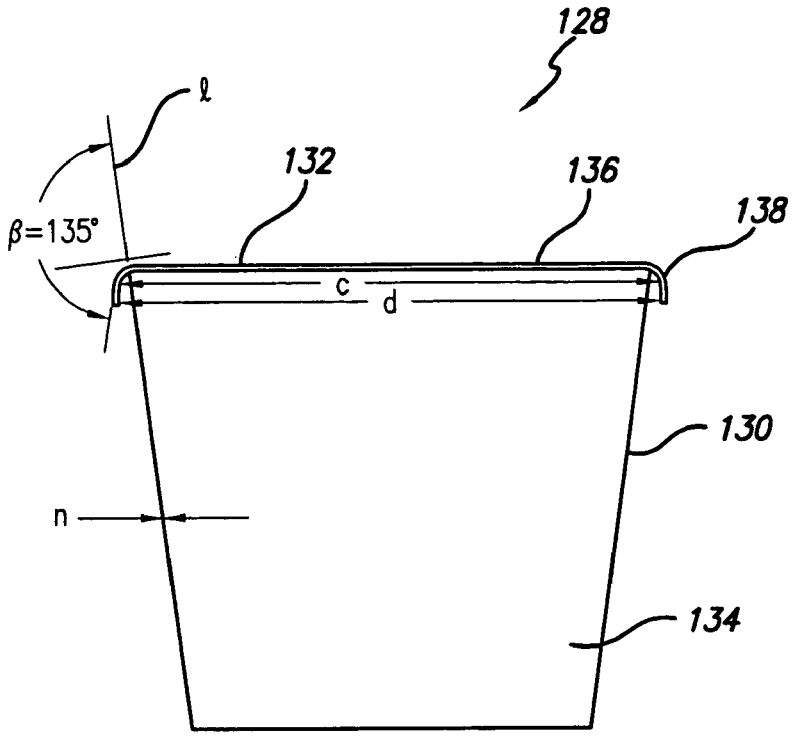
FIG. 11 is a side sectional view of a cup having a brim curl with an arc angle of 135°.
Figure 12:
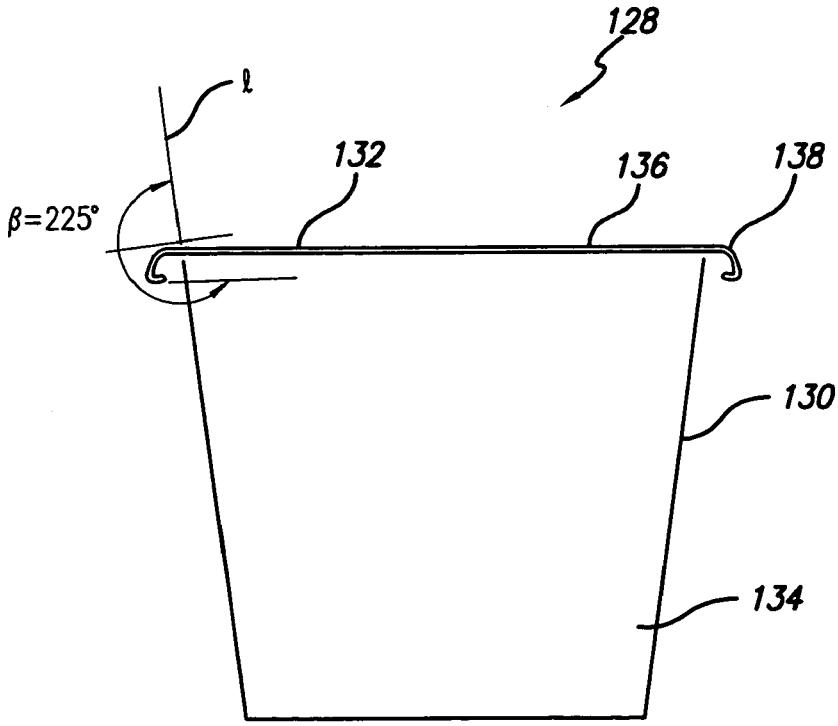
FIG. 12 is a side sectional view of a cup having a brim curl with an arc angle of 225°.
Figure 13:
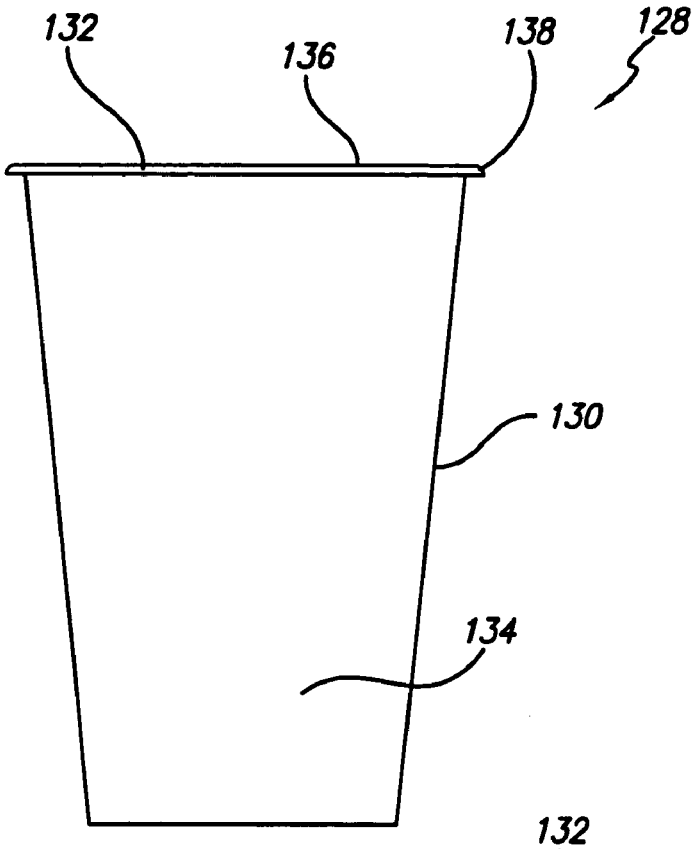
FIG. 13 is a side plan view of a cup.
Figure 14:
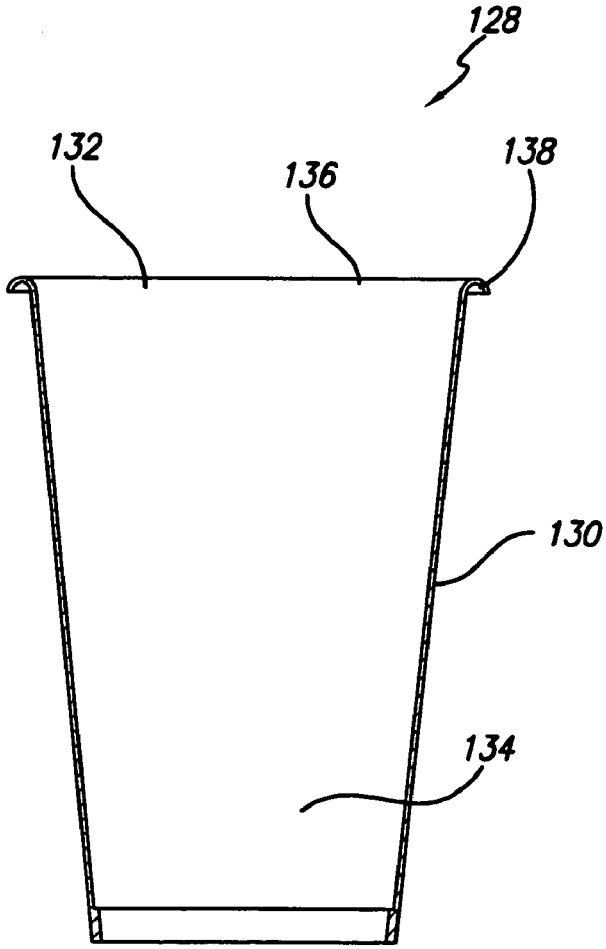
FIG. 14 is a side sectional view of the cup of FIG. 13.
Figure 15:
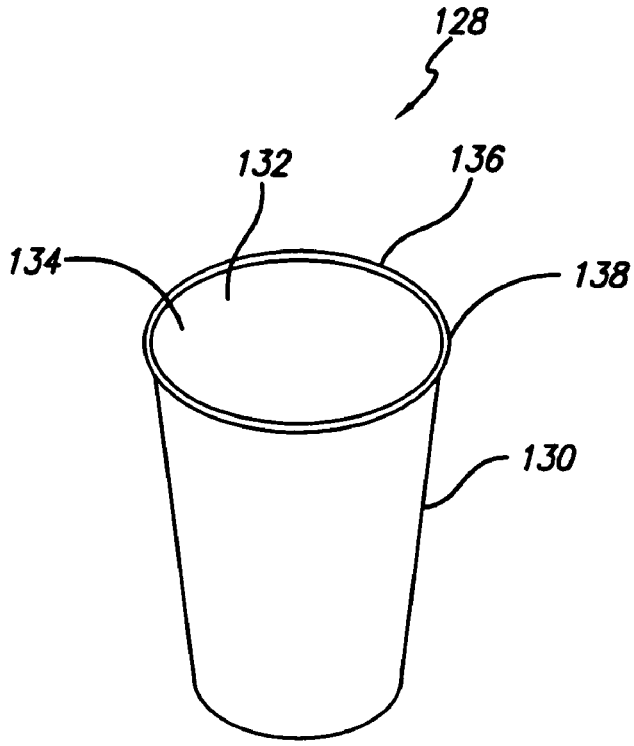
FIG. 15 is a perspective view of the cup of FIG. 13.

A disposable cup 128, which is constructed using a thermoform process, is shown in FIG. 11. This disposable cup 128 is constructed to be mated with the previously described lid. The cup wall 130 defines a cup opening 132 and a cup cavity 134. The cup brim 136 includes a partially formed brim curl 138, which extends entirely around the cup brim 136. Alternatively, the brim curl 138 may extend only partially around the cup brim 136. The brim curl 136 is generally described by its arc angle, β, which is defined as the angle between the imaginary line, l, disposed tangent to the cup wall 130 and the imaginary line extending from the end of the brim curl 138 as shown. The arc angle, β, is preferably between about 135° to about 225° but, depending upon the actual construction of the lid, may also be outside of this range. FIG. 11 shows a cup 128 having a brim curl 138 with an arc angle, β, of about 135°. FIG. 12 shows a cup 128 having a brim curl 138 with an arc angle, β, of about 225°. FIGS. 13, 14, and 15 illustrate a side view, a cross-sectional view, and a perspective view, respectively, of a disposable cup 128 having a partially formed brim curl 138.

The brim curl 138 of the disposable cup 128 may be placed in multiple configurations. For example, FIG. 16 shows a disposable cup 128 with a lid 110 sealingly seated on the brim 136. The brim curl 138 of this cup 128 extends entirely around the brim 136 in a lip configuration 140. In the lip configuration 140, the brim curl 138 arcuately and concavely extends away from cup opening 132 to form a brim lip 144. In an alternative configuration, which is not illustrated, the brim curl extends only partially around the brim.

Figure 17:
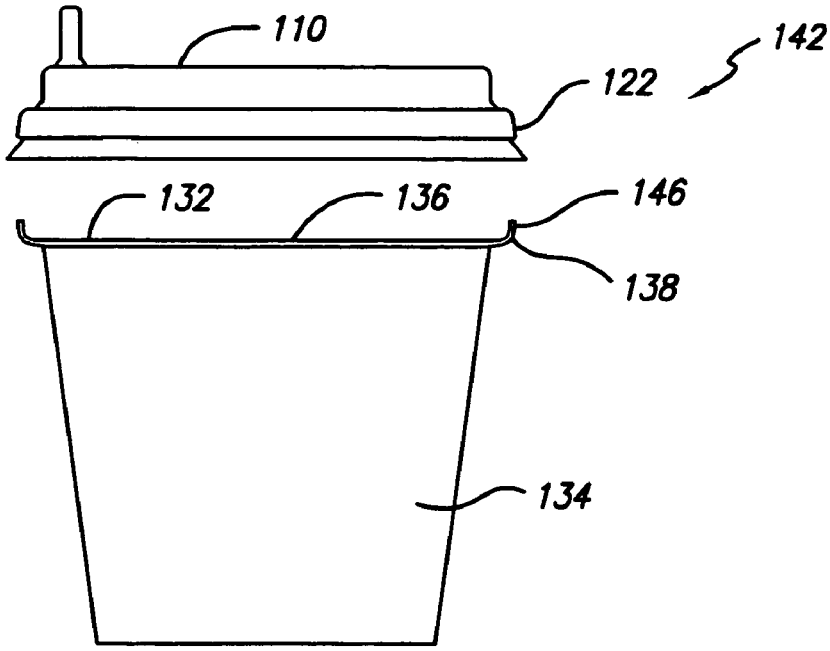
FIG. 17 is a side sectional view of the cup and lid of FIG. 16 following disengagement.

When the lid 110 is removed from the cup 128, as shown in FIG. 17, the lid causes the brim curl 138 to deform into a flare configuration 142. In the flare configuration 142, the brim curl 138 arcuately and convexly extends away from cup opening 132 to form a brim flare 146. As shown, the lid 110 has deformed the entire brim curl 138. In practice, however, the lid 110 may partially deform the brim curl 138, such that the flare configuration 142 extends only partially around the brim 136.

Referring back to FIG. 11, the cup brim 136 has a brim curl diameter, c, sized relative to the lid skirt diameter, a, (shown in FIG. 1) to allow the brim curl 138 to sealingly associate with the lid skirt 122 as shown in FIG. 16. The brim lip 144 has a lip diameter, d, which is sized relative to the lid rim diameter, b, to allow the brim lip 144 to fasteningly associate with the angular rim 124 (or ribs 121, depending on the lid configuration).

Referring to FIG. 16, the cup wall 130 is preferably constructed of a translucent plastic material and has a wall thickness, n, which is preferably $^{15}/_{1000}$ inch. The wall thickness, n, however, may be between about $^{9}/_{1000}$ inch and about $^{25}/_{1000}$ inch. In addition, although the cup 128 is preferably constructed of a plastic and/or composite material, it may be constructed of any suitable material and/or combination of materials, such as paper and/or polyester (APET), polypropylene or polyethylene—alone or as a coating on a paperboard substrate—all of which are well suited from a child safety perspective.

Figure 18:
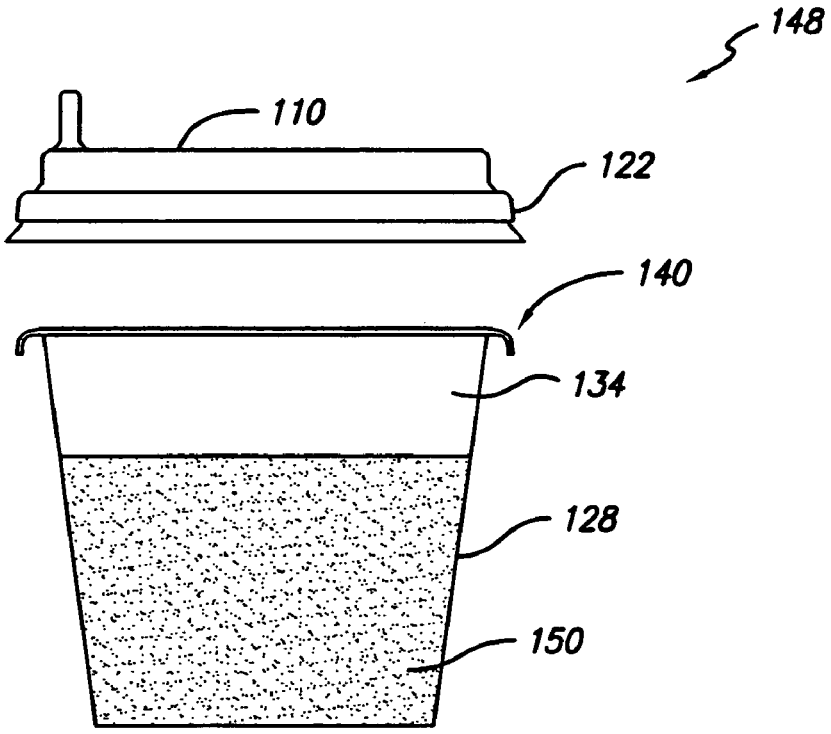
FIG. 18 is a side sectional view of a cup and lid prior to engagement.
Figure 19:
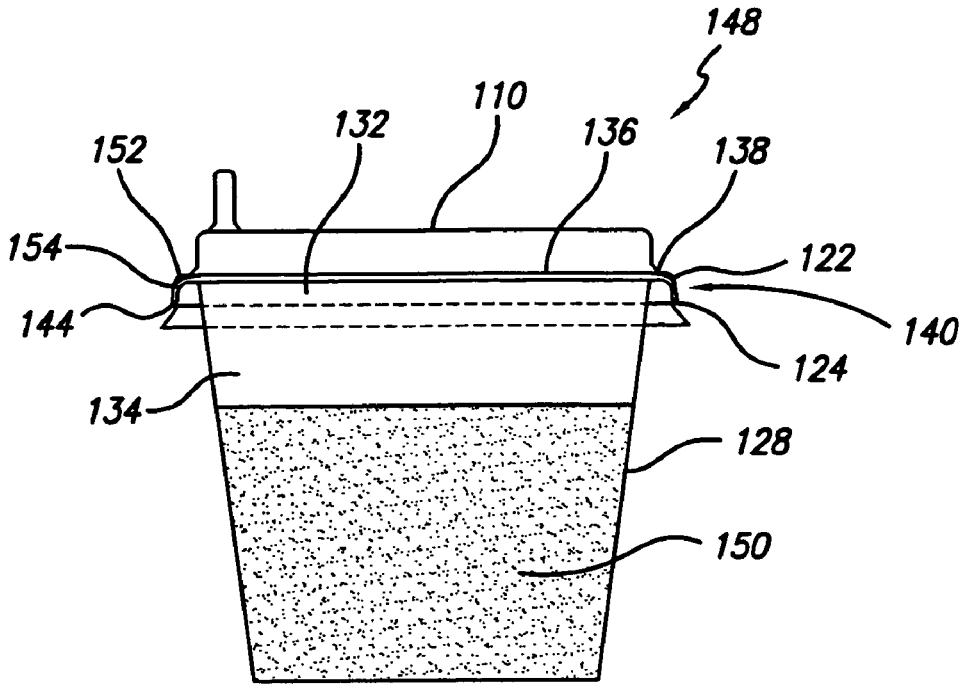
FIG. 19 is a side sectional view of a cup sealingly engaged to a lid with liquid in the cup.

A disposable drinking device 148 is shown in FIG. 18. A liquid 150 is contained within the cup cavity 134 and a lid 110 is disposed loosely associated with the cup 128. FIG. 19 shows the lid 110 snap-fittingly associated with the cup 128 containing the liquid 150. The cup 128 is shown with the brim curl 138 in the lip configuration 140, wherein the brim curl diameter, c, is sized relative to the lid skirt diameter, a to allow the brim curl 138 to sealingly associate with the lid skirt 122 at a first sealing location 152 and a second sealing location 154. In addition, the lip diameter, d, is sized relative to the rim diameter, b, to allow the brim lip 144 to fasteningly associate with the angular rim 124 when the lid 110 is snap-fittingly associated with the cup 128.

Figure 20:
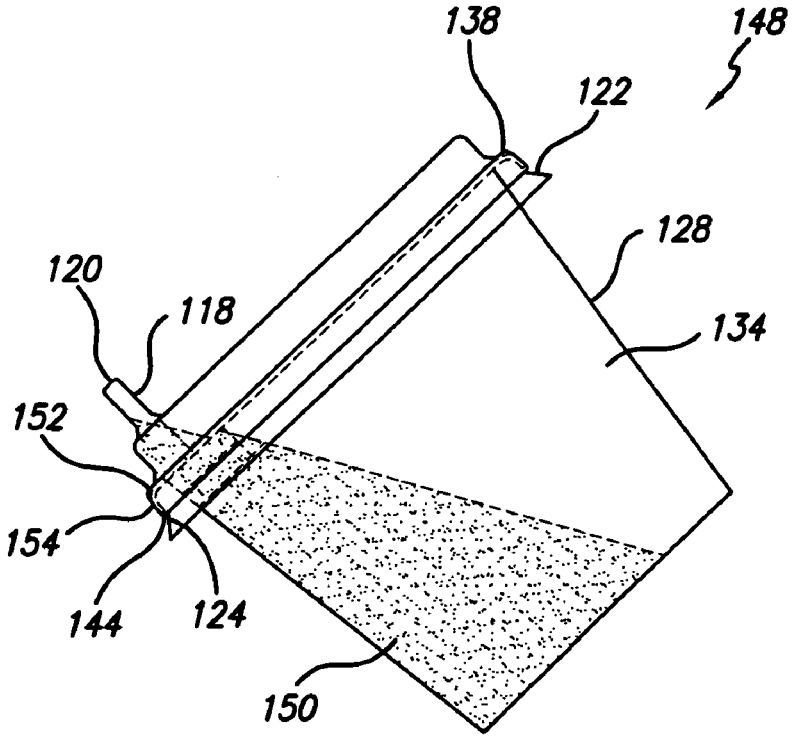
FIG. 20 is a side plan view of a tilted cup sealingly engaged to a lid with liquid in the cup.

The disposable drinking device 148 is shown in tilted fashion in FIG. 20. The lid 110 is associated with the cup 128 such that the brim curl 138 is sealingly associated with the lid skirt 122 at a first sealing location 152 and a second sealing location 154. In addition, the angular rim 124 is fasteningly associated with the brim lip 144. Having both the brim curl 138 sealingly associated with lid skirt and the angular rim 124 fasteningly associated with the brim lip 144 advantageously allows the disposable drinking device 148 to be tilted without spilling the liquid 150 contained in the cup cavity 134. Moreover, having the spout opening 120 sized and/or shaped to contain liquid until suction is applied to the lid spout 118 also advantageously allows the disposable drinking device 148 to be tilted without spilling the liquid 150 contained in the cup cavity 134. In accordance with an exemplary embodiment, the lid 110 and the cup brim 136 are round in shape and the angular rim 124 is disposed relative to the brim lip 144 to provide for a snap closure feature that snaps annularly about brim curl 138.

The lid 110 is novel and unique from existing lids in that 1) it is constructed using a thermoform process rather than via a mold injection process; 2) the interaction between the angular rim 124 and the brim lip 144 makes the lid 128 easy to compress onto the cup 128, but when lid is removed from the cup, the angular rim 124 pushes against the brim lip 144, forcing the brim curl 138 at least partially into the flare configuration 142, thus destroying the seal and the ability to be resealed; 3) it is formed from a clear material which allows visual identification of the type and level of liquid 150 disposed within the cup 128; 4) the spout opening 120 is sized and/or shaped to minimize liquid from leaking from the cup; and 5) the disposable nature of the lid 110 permits the disposable drinking device 42 to be wholly disposable.

The cup 128 is novel and unique from existing cups in that 1) the cup 128 includes a configurable cup brim 136 for a true single-use purpose; 2) the cup 128 may be constructed from a number of truly disposable materials, such as paper or a thermoform plastic; and 3) the cup 128 is stackable, making it easy to transport and/or package. The cup 128 is preferably a crush-resistant cup and includes a coating, such as a foam material, that provides tactile stimulation to a child using the cup 128.

Figure 21:
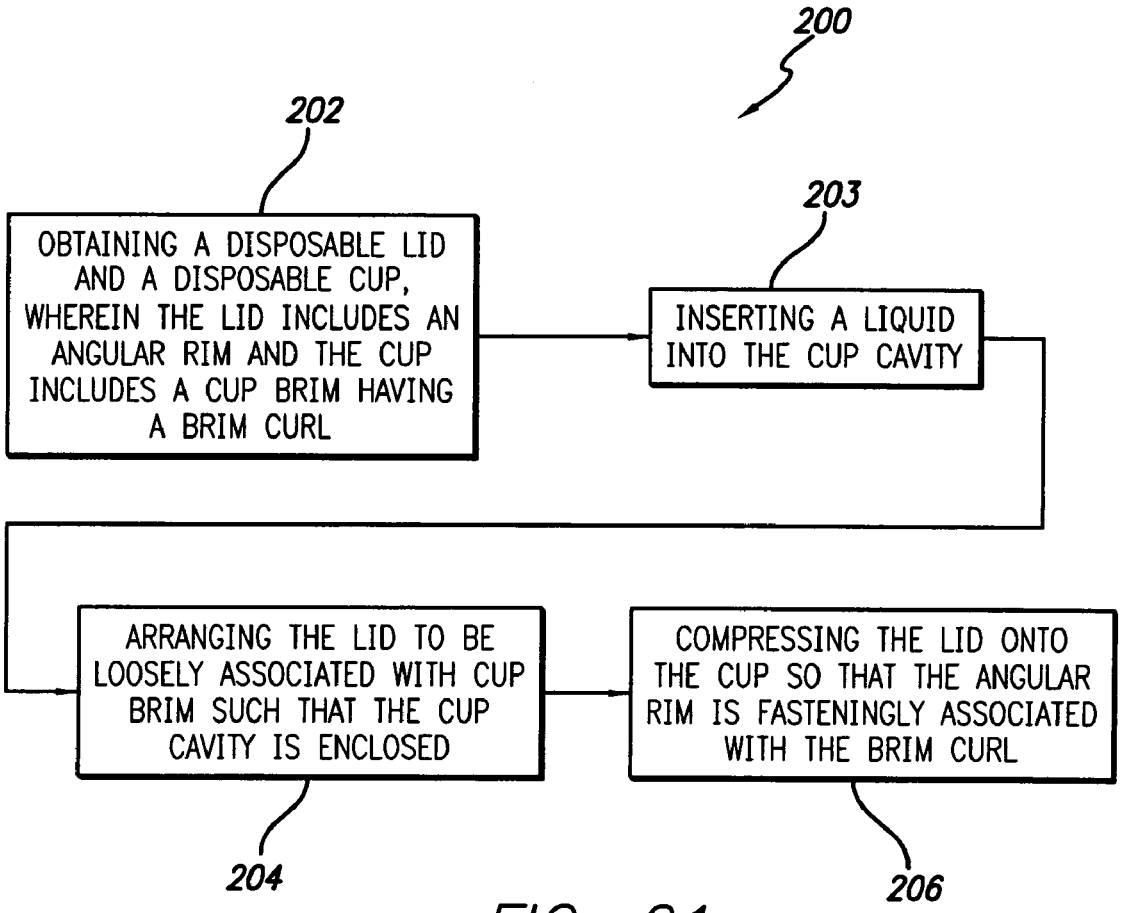
FIG. 21 is a block diagram illustrating a method for implementing a disposable drinking device.

Referring to FIG. 21, a method 200 for implementing the disposable drinking device 148 is shown and described. As shown in blocks 202 and 203, the lid 110 and the cup 128 are obtained and a liquid 150 is inserted into the cup cavity 134. The lid 110 is then arranged to be loosely associated with the cup brim 136, so as to loosely cover the cup cavity 134 as shown in block 204. The lid 110 is then compressed onto the cup brim 136, as shown in block 206, such that the internal rim surface 126 of the angular rim 124 becomes fasteningly associated with the brim lip 144. At this point, the disposable drinking device 148 is ready to be used and discarded after use.

In accordance with an exemplary embodiment, while a disposable drinking device 148 and a method 200 for implementing the same is described and discussed below it should be understood that the method and device of the invention may be applied to other product containers, such as storage bowls, serving bowls, plates and/or insulated cups.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A container comprising:

a receptacle having an opening with a brim formed about the opening wherein the brim includes a brim curl; and a lid removably and sealingly engaged to the brim curl, the lid being adapted to deform the brim curl upon being disengaged, wherein the lid cannot sealingly engage the deformed brim.

2. The container of claim 1, wherein the lid is adapted to partially deform the brim curl upon being disengaged.

3. A container system comprising:

a receptacle having an opening with a brim formed about the opening, the brim including a partially formed brim curl in a first configuration; and a lid adapted to sealingly engage the brim when the partially formed brim curl is in a first configuration and to deform the partially formed brim curl into a second configuration upon being disengaged such that the lid is incapable of sealingly engaging the brim when the partially formed brim curl is in the second configuration.

4. The container system of claim 3, wherein the lid is adapted to sealingly engage the brim curl when the brim curl is in the first configuration.

5. The container system of claim 3, wherein in the first configuration the brim curl arcs generally outwardly and downwardly.

6. The container system of claim 3, wherein in the second configuration the brim curl at least partially arcs generally outwardly and upwardly.

7. The container system of claim 3, wherein the lid includes a lid skirt having an inward-extending rim surface adapted to bear against a distal end of the brim curl when the lid sealingly engages on the brim.

8. The container system of claim 3, wherein the brim curl forms an arc angle between about 135° to about 225° along a line tangent to a wall of the receptacle when in the first configuration.

9. A container system comprising:

a receptacle having an opening with a brim formed about the opening, the brim including a brim curl in a first configuration; and a lid adapted to sealingly engage the brim curl when the brim curl is in the first configuration, the lid including a lid skirt having an inward-extending rim surface adapted to bear against a distal end of the brim curl when the lid sealingly engages the brim curl, and to deform the brim curl into a second configuration upon being disengaged, wherein the lid cannot sealingly engage the brim curl when the brim curl is in the second configuration.

10. The container system of claim 9, wherein the brim curl forms an arc angle between about 135° to about 225° along a line tangent to a wall of the receptacle when in the first configuration.

11. The container system of claim 9, wherein in the first configuration the brim curl arcs generally outwardly and downwardly.

12. The container system of claim 9, wherein in the second configuration the brim curl at least partially arcs generally outwardly and upwardly.

13. A container system comprising:

a receptacle having an opening and a brim formed about the opening; and a lid including means for sealingly engaging the brim and means for deforming the brim upon being disengaged wherein the lid cannot sealingly engage the deformed brim.

* * * * *